US007940037B2

(12) United States Patent
Prexl

(10) Patent No.: US 7,940,037 B2
(45) Date of Patent: May 10, 2011

(54) DRIVER FOR LIGHT EMITTING SEMICONDUCTOR DEVICE

(75) Inventor: Franz Prexl, Niederding (DE)

(73) Assignee: Texas Instruments Deutschland GmbH, Freising (DE)

( * ) Notice: Subject to any disclaimer, the term of this patent is extended or adjusted under 35 U.S.C. 154(b) by 384 days.

(21) Appl. No.: 12/247,088

(22) Filed: Oct. 7, 2008

(65) Prior Publication Data

US 2009/0096388 A1 Apr. 16, 2009

Related U.S. Application Data

(60) Provisional application No. 61/016,987, filed on Dec. 27, 2007.

(30) Foreign Application Priority Data

Oct. 8, 2007 (DE) ..... 10 2007 048 243

(51) Int. Cl.
*G05F 3/16* (2006.01)

(52) U.S. Cl. ..... 323/315; 323/313; 323/314; 323/316; 323/304

(58) Field of Classification Search ..... 323/312–317, 323/311, 304; 327/530, 534, 535, 537, 538, 327/540–545; 315/247, 291, 185 S, 224
See application file for complete search history.

(56) References Cited

U.S. PATENT DOCUMENTS

| | | | | |
|---|---|---|---|---|
| 7,170,335 | B2 | 1/2007 | Elsheimer et al. | |
| 7,230,474 | B2 | 6/2007 | Yamamoto et al. | |
| 2007/0008255 | A1 | 1/2007 | Emek et al. | |
| 2007/0069712 | A1 * | 3/2007 | Kamatani | 323/315 |

* cited by examiner

*Primary Examiner* — Tuyet Thi Vo
(74) *Attorney, Agent, or Firm* — John J. Patti; Wade J. Brady, III; Frederick J. Telecky, Jr.

(57) ABSTRACT

An electronic device is provided comprising a driver for light emitting semiconductor devices. The driver includes a first MOS transistor (MN1) coupled with a channel to the light emitting semiconductor device at an output node. The first MOS transistor (MN1) is configured to determine a current through the light emitting semiconductor device (LED). A control loop is provided so as to control the first MOS transistor to maintain the magnitude of the current through the light emitting semiconductor device at a target value when a voltage drop across the first MOS transistor (MN1) changes. A second MOS transistor is coupled to the output node and biased so as to supply an auxiliary current to the output node, when the voltage drop across the first MOS transistor drops below a minimum voltage level and a feedback loop is provided to reduce the current through the light emitting semiconductor device by an amount proportional to the auxiliary current.

9 Claims, 4 Drawing Sheets

DRIVER FOR LIGHT EMITTING SEMICONDUCTOR DEVICE

This patent application claims priority from German Patent Application No. 10 2007 048 243.6, filed 8 Oct. 2007, and from U.S. Provisional Patent Application No. 61/016,987, filed 27 Dec. 2007, the entireties of which are incorporated herein by reference.

FIELD OF THE INVENTION

The invention relates to an electronic device including a driver for a light-emitting semiconductor device.

BACKGROUND

Electronic devices for driving light-emitting semiconductor devices, like light-emitting diodes (LED), often include a current mirror, one end of which is coupled to the light-emitting semiconductor device for determining a current through the light-emitting semiconductor device. The electronic device also includes a control loop for stabilizing the current through the LED at its target value. Another end of the LED is coupled to a power supply, the supply voltage level of which is controlled to a specific level necessary to drive the current through the LED. The LED intensity depends on the LED current. At low supply voltages in the range of the LED forward voltage, the drain voltage of the current mirror output transistor approaches 0 V. Consequently, the current through the LED runs out of control, when the supply voltage at the LED is not high enough to sink the programmed current into the current mirror output transistor. In this situation, the output transistor is typically controlled to have minimum impedance in order to sink maximum current without actually sinking any substantial current. However, in this situation, a very small change of the supply voltage level can cause very high currents to be fed into the transistor. The control loop, in its overdriven state, is unable to counteract these effects. The desired brightness of the LED cannot be achieved, the LED control fails and the electronic device can even be destroyed.

A conventional solution avoids the current overshoot by comparing the drain-source voltage of the current mirror output transistor with a chosen reference value, to turn off the control loop if a the voltage falls below a minimum voltage level in order to avoid the current overshoot. However, there is always a risk that this comparator-based control mechanism may start oscillating around the switching or operating point, and the achievable efficiency is lessened due to the additional margin that has to be preserved to prevent the oscillations.

SUMMARY

It is an object of the invention to provide an electronic device including a driver for a light-emitting semiconductor device which avoids overshoot and has reduced complexity and power consumption.

In one aspect, an electronic device is provided that includes a driver for light-emitting semiconductor devices. The driver comprises a first transistor, coupled with a channel to the light-emitting semiconductor device at an output node. The first transistor is configured to determine a current through the light-emitting semiconductor device. A control loop is provided for controlling the first transistor, such that the magnitude of the current through the light-emitting semiconductor device remains at a target value, when a voltage drop across the first transistor's channel changes. A second transistor is coupled to the output node and biased so as to supply an auxiliary current to the output node, when the voltage drop across the first transistor's channel drops below a minimum voltage level. At low supply voltages, the voltage drop across the channel of the first transistor approaches 0 V. If the supply voltage is not high enough to sink the programmed current into the transistor, the control loop will control a control input of the first transistor to an upper limit, in order to open the transistor's channel as far as possible. In this situation, the second transistor starts feeding an auxiliary current through the channel of the first transistor.

Advantageously, the electronic device according to the invention further comprises a first current mirror coupled with the first transistor, so as to define the current to be supplied to the light-emitting semiconductor device. The second transistor is then coupled to the first current mirror in order to reduce the amount of current mirrored to the first MOS transistor if the auxiliary current increases. In this manner, a feedback loop is provided that automatically reduces the current through the light-emitting semiconductor device whenever the supply voltage used for driving the light-emitting semiconductor device is not high enough to deliver the target current. However, this keeps the control loop at an operating point, where sudden overshoots can be avoided.

The electronic device further comprises a detection stage for detecting that the voltage drop across the first transistor's channel drops below a minimum voltage level and for issuing a corresponding detection signal. This detection stage allows an external device to act in response to the detection signal; for example, for increasing the external supply voltage for the light-emitting semiconductor device. Also, the detection signal can be used for the driver circuit itself. Accordingly, the electronic device can comprise controlling means for selectively adjusting a control voltage of the second transistor in response to the detection signal.

Depending on the application requirements, the circuit according to the invention can be either optimized for maximum efficiency or for minimum output current overshoot at certain conditions. For small output currents, where efficiency is less relevant, it can be useful to change the internal operating points. The adjustment can be carried out by use of the detection signal or based on a setting for the output current. For example, the control input of the second transistor can be used to provide more auxiliary current for a higher voltage drop across the first transistor in order to avoid any overshoot or to reduce overshoot further. Whenever the voltage drop across the first transistor's channel drops below its minimum value for maintaining the desired performance, the second transistor starts increasing a current flow, which reduces the output current automatically, while the control loop for keeping the output current at a target value works and does not allow any output current overshoot. For high currents through the light-emitting semiconductor device, the efficiency can play an important role. Therefore, the minimum voltage drop (threshold level) across the first transistor should be adjustable in accordance with the required current through the light-emitting semiconductor device. The adjustment is preferably performed by increasing or decreasing a control input (for example, the gate voltage) of the second transistor.

In another aspect, the invention provides a method for operating a driver for a light-emitting semiconductor device. In an embodiment, a current is supplied to the light-emitting semiconductor device by a first transistor which is part of a current mirror configuration. The current mirror is controlled so as to maintain a target magnitude of the output current through the first transistor, if the voltage drop across the first transistor's channel varies. When the voltage drop across the first transistor's channel drops below a minimum voltage level, an auxiliary current is fed to the first transistor's channel. Simultaneously, the current mirrored to the first transistor is reduced by an amount proportional to the auxiliary current. Further, a detection signal can be issued when the voltage drop across the first transistor's channel drops below a minimum voltage level. A control voltage of the second transistor can be adjusted in response to the a setting of the output current or in response to the detection signal in order to change the operating points of the second transistor.

BRIEF DESCRIPTION OF THE DRAWINGS

Further features and advantages of the invention will become apparent from the following description of example embodiments, taken with reference to the accompanying drawings, wherein.

DETAILED DESCRIPTION OF EXAMPLE EMBODIMENTS

Figure 1:
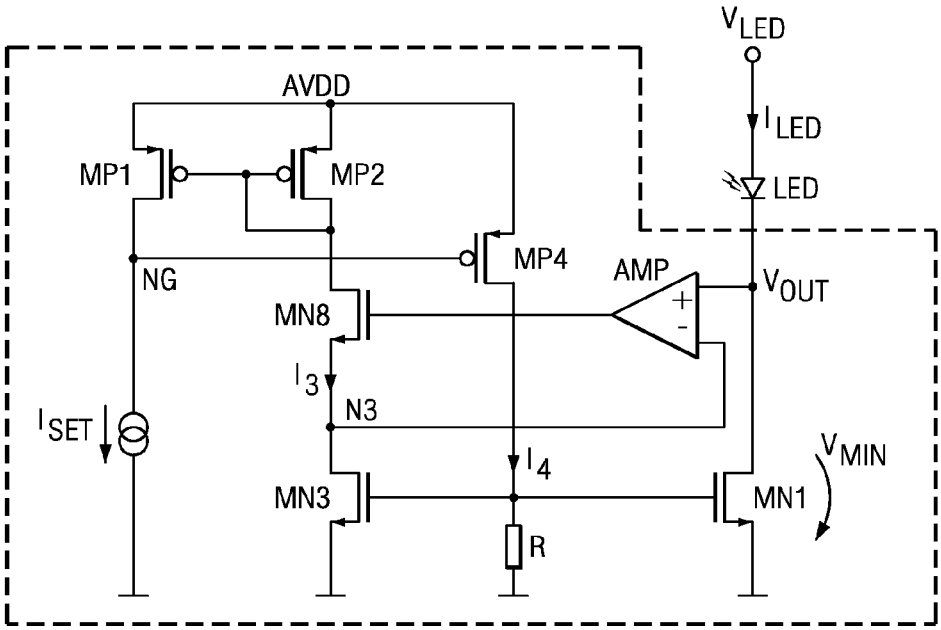
FIG. 1 (PRIOR ART)
FIG. 1 (Prior Art) shows a simplified circuit diagram of a driver according to the prior art.

FIG. 1 shows a simplified circuit diagram of a driver according to the prior art. A first transistor MN1 is coupled to another transistor MN3 in a current mirror configuration. The drain of the first transistor MN1 is coupled to a cathode of a light-emitting diode LED. The current $I_{LED}$ through the LED is defined by the first transistor MN1. An amplifier measures the voltage at the output node $V_{OUT}$, which is equal to the voltage drop across the first transistor's channel $V_{MIN}$. The output of the amplifier AMP is coupled to a transistor MN8 in a voltage follower configuration. Further, a target output current $I_{LED}$ is set through the current source $I_{SET}$, which sinks a current to transistor MP1. Transistor MP1 is coupled with a gate to transistor MP2. Transistor MP4 is coupled with a drain to the gates of transistors MN1 and MN3. Further, a resistor R is coupled to the gates of MN1 and MN3. Transistor MP2 is a diode-coupled transistor having a drain coupled to a drain of MN8.

If $I_{LED}$ increases above its target value, the current $I_3$ through MN3 also increases. The transistors MP2 and MP1 are coupled in a current mirror configuration such that the current through MP1 increases, as well. If transistor MP1 is biased to source a current greater than $I_{SET}$, the voltage at node NG will increase. In response thereto, the transistor MP4 is closed and a current $I_4$ through MP4 and resistor R is reduced. The gate source voltages of transistors MN1 and MN3 are reduced due to the smaller voltage drop across resistor R. Accordingly, transistor MN1 is closed and current $I_{LED}$ will be reduced. The control loop including the amplifier AMP, and transistor MN8 serves to keep the voltage levels at node $V_{OUT}$ and N3 constant. If the voltage at node $V_{OUT}$ increases, the voltage at node N3 is also increased, by reducing the voltage drop across the channel of transistor MN8. In this way, it is possible to reduce the effects of voltage variations at node $V_{OUT}$ on the current through MN1 and MN3.

If the voltage across transistor MN1 drops below a minimum level, transistor MP4 will be opened as much as possible in order to maintain current $I_{LED}$ at its target value. However, the voltage drop across resistor R will reach its upper limit and the control mechanism will be set out of function. If the supply voltage $V_{LED}$ varies slightly, this can have a strong impact on the current $I_{LED}$, as the transistor MN1 has minimum impedance. Further, as the control loop is out of function, the gate source voltage of transistor MN1 cannot be reduced quickly enough in order to avoid a current overshoot.

Figure 2:
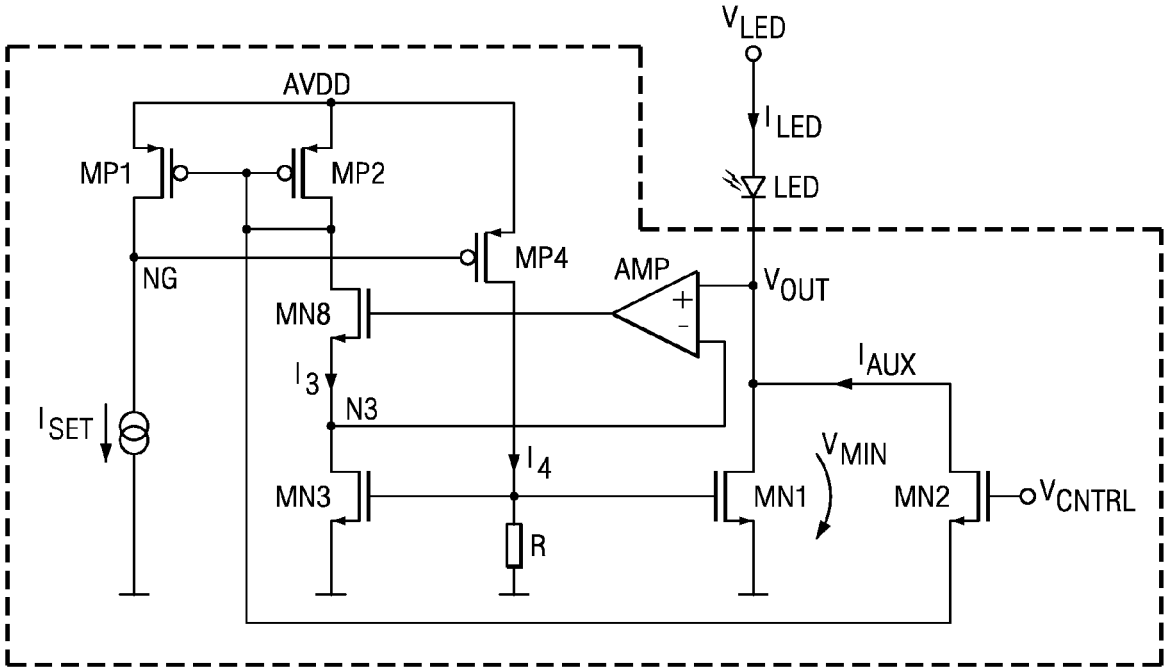
FIG. 2 shows a simplified circuit diagram of a driver according to a first embodiment of the invention.

FIG. 2 shows a simplified circuit diagram of a first embodiment of the invention. In addition to the circuit shown in FIG. 1, there is a transistor MN2 coupled between the gates of MP1 and MP2 and to the output node $V_{OUT}$. The transistor MN2 receives a control voltage $V_{CNTRL}$ for biasing the transistor MN2, such that an auxiliary current $I_{AUX}$ flows through transistor MN2 in inverse direction (from source to drain) if the voltage drop $V_{MIN}$ across transistor MN1 falls below a lower limit. This way, the control loop including transistors MN3, MP2, MP1, current source $I_{SET}$, and MP4 will not be brought to its upper limit. Instead, a current $I_{AUX}$ is drawn from the current mirror MP2 and MP1, providing that current $I_3$ does not increase or increases less above a specific limit, which provides that MP4 is not closed to the same extent as in the configuration shown in FIG. 1. This provides that the gate voltages of transistors MN1 and MN3 remain at a lower voltage level for the same $V_{LED}$ value, since the current is reduced by $I_{AUX}$. If $V_{LED}$ rises again, and $V_{MIN}$ resumes a voltage level above the lower limit, MN2 is dimensioned to switch automatically off and no additional current $I_{AUX}$ is fed to the output node $V_{OUT}$. This way, it is possible to keep the control loop alive and to avoid undesired current overshoots through the LED and transistor NM1.

Figure 3:
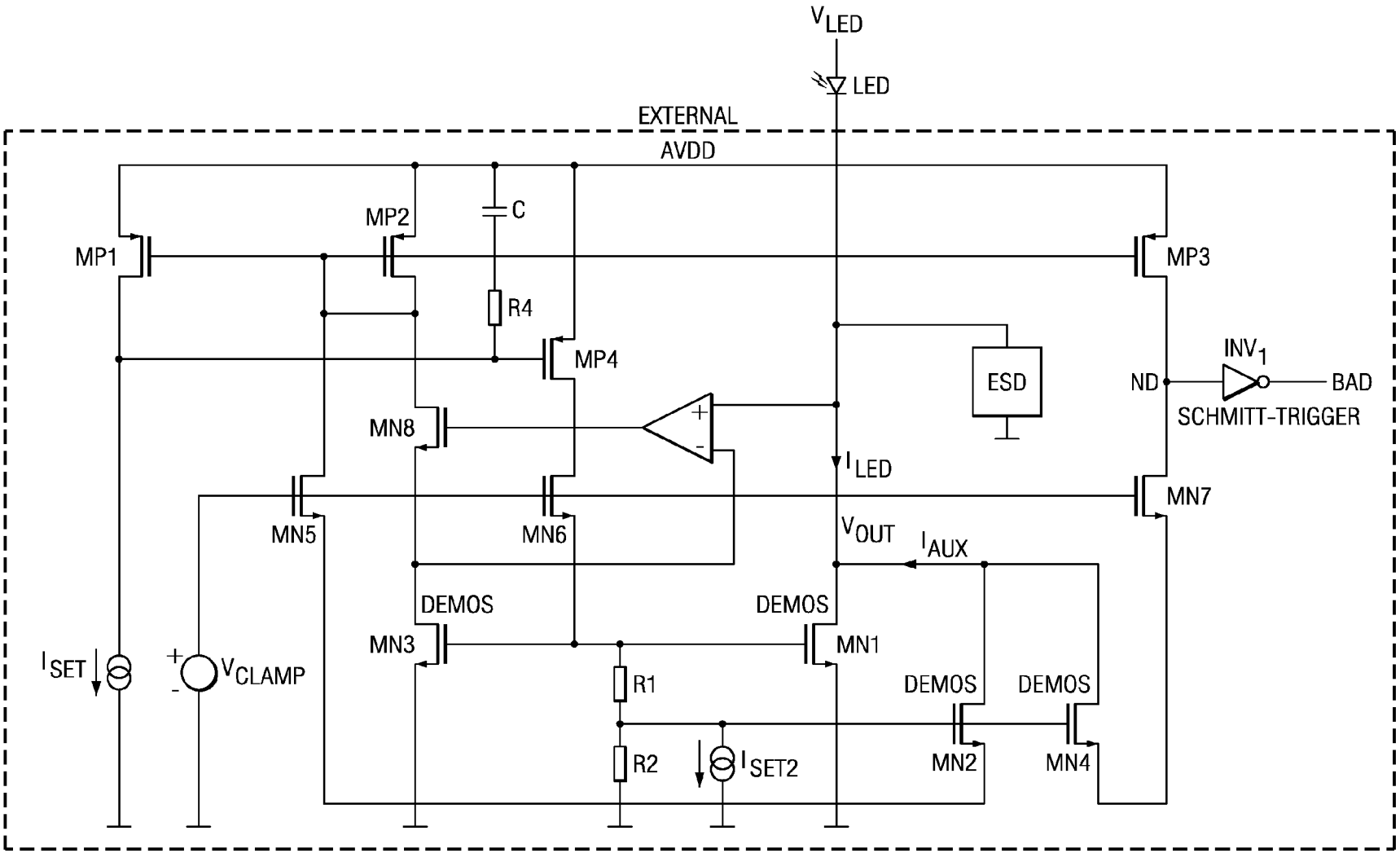
FIG. 3 shows a simplified circuit diagram of a driver according to a second embodiment of the invention.

FIG. 3 shows a simplified circuit diagram of a second preferred embodiment of the invention. As shown, the circuit of FIG. 3 has a detection stage including transistors MN4, MN7 and MP3, as well as a Schmitt-Trigger $INV_1$ coupled to a detection node ND. The detection stage serves to indicate through a signal BAD, whether the voltage level at output node $V_{OUT}$ has dropped below the lower limit. In this situation, the output signal BAD can be used to indicate to a voltage regulator to increase the supply voltage $V_{LED}$, or to carefully monitor the current through the LED. Preferably, transistors MN1, MN3, MN2, MN4 are drain-extended MOS devices, which can sustain voltages up to 12 V at their drain terminals but only 3.3 V at the gate and source terminals. Therefore, transistors MN5 to MN7 have been included, in order to protect the DMOS transistors MN1, MN2, MN3 and MN4. Resistor R shown in FIG. 2, is now subdivided into two resistors R1 and R2 to enable the minimum drain voltage of transistor MN1 to be defined dependent on a voltage divider ratio.

For high output currents through the LED, the efficiency can play an important role. Therefore, the threshold voltage at which the transistor MN2 turns on or off should be adjusted depending on the magnitude of the LED current $I_{LED}$. This is achieved by coupling a second current source $I_{SET2}$ to the gates of MN2 and MN4. The current $I_{SET2}$ is proportional to $I_{SET}$. In a practical implementation, $I_{SET2}$ could be equal to Iset. Therefore, at high output currents $I_{LED}$, the gate of the current mirror MN1, MN3 can reach higher voltage levels than for smaller output currents $I_{LED}$. The transistor MN1 can even go into linear operation mode which allows very small voltage drops across transistor MN1. Since transistors MN2 and MN4 operate in inverse mode if an auxiliary current $I_{AUX}$ is required, a reduced gate voltage of transistors MN2 and MN4 provides that less auxiliary current $I_{AUX}$ can be provided. For the same voltage level $V_{LED}$, the auxiliary current $I_{AUX}$ starts later, if the gate voltage of MN2 is reduced. This increases efficiency, but increases at the same time the risk of overshoot. The current mirrors MP1 to MP2 and MP1 to MP3 are advantageously dimensioned such that transistor MN4 contributes only a very small current to $I_{AUX}$. The ratio could be, e.g., 250, such that the current $I_{LED}$ would be reduced by less than 0.5% when MN4 is switched on.

Figure 4:
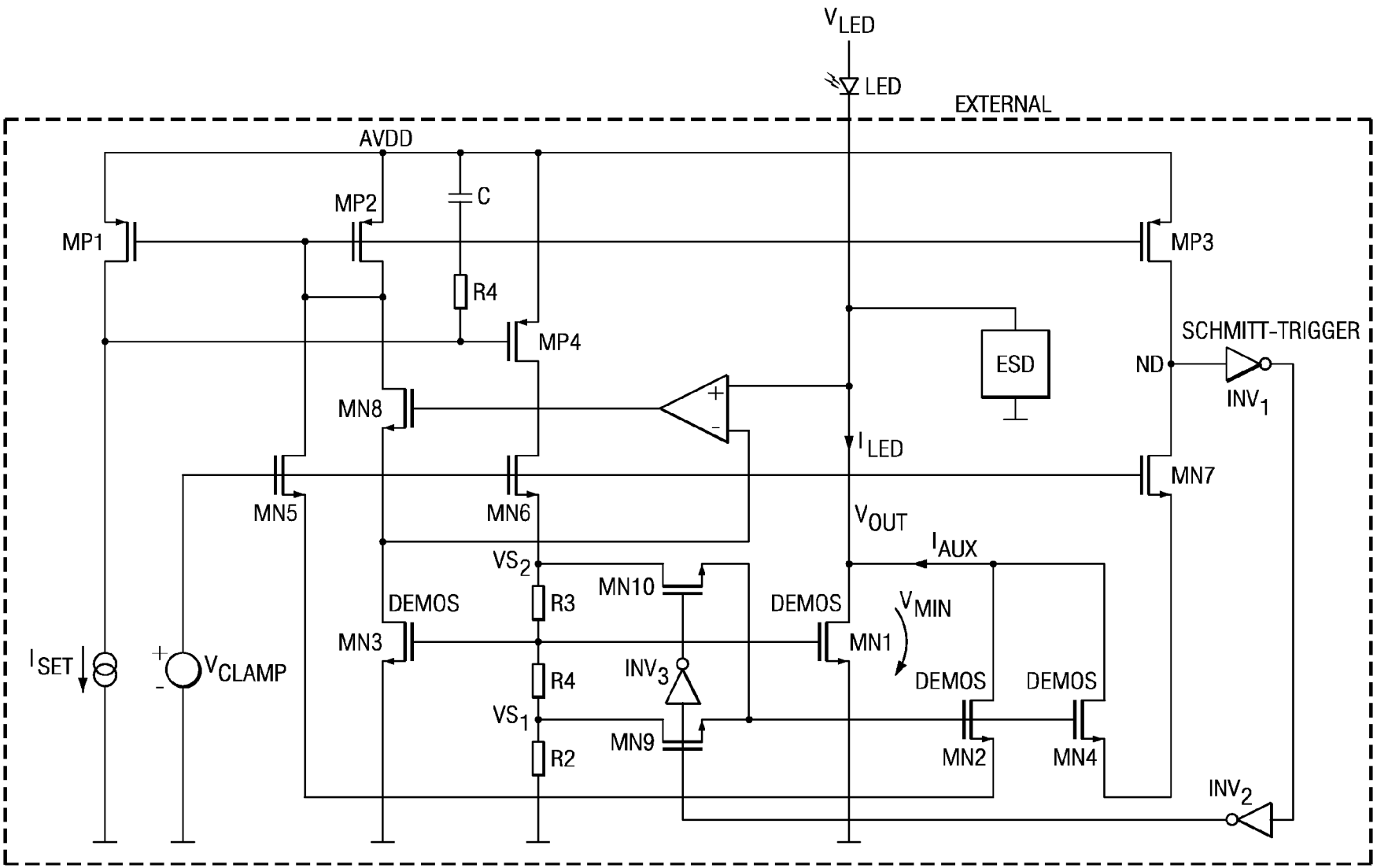
FIG. 4 shows a simplified circuit diagram of a driver according to a third embodiment of the invention.

FIG. 4 shows a simplified circuit diagram of a third embodiment of the invention. With respect to the embodiment shown in FIG. 3, there is an additional feedback connection from detection node ND through Schmitt-Trigger $INV_1$, $INV_2$, and $INV_3$, and transistors MN9 and MN10. Dependent on the voltage level at the detection node ND, transistors MN9 or MN10 are alternately switched on such that the gate voltage of transistors MN2 and MN4 is changed between voltage level $VS_1$ and $VS_2$. An additional resistor R3 is coupled between the source of transistor MN6 and the gates of transistors MN1 and MN3.

During normal operation, the voltage level at detection node ND is high. Accordingly, the output voltage of $INV_1$ is low, the output voltage of $INV_2$ is high, and the output voltage of $INV_3$ is low. Transistor NM9 is conductive, and transistor MN10 is not conductive. Accordingly, the gate voltage of transistors MN2 and MN4 is $VS_1$. If the voltage level at detection node ND drops below a specific level, transistor MN10 becomes conductive and MN9 not conductive. In this situation, the gate voltage of MN2 and MN4 becomes $VS_2$. The voltage level at detection node ND depends on the output current setting Iset through current mirror MP1, MP3. The higher gate voltage level $VS_2$ provides that MN2 and MN4 start earlier and provide more $I_{AUX}$ current than for the lower gate voltage level $VS_1$. Therefore, the circuitry including $INV_1$, $INV_2$, $INV_3$, MN9 and MN10, as well as MP3 and MN7, provides that the driver automatically adapts to different conditions of Iset, i.e., different conditions of $I_{LED}$.

Figure 5A:
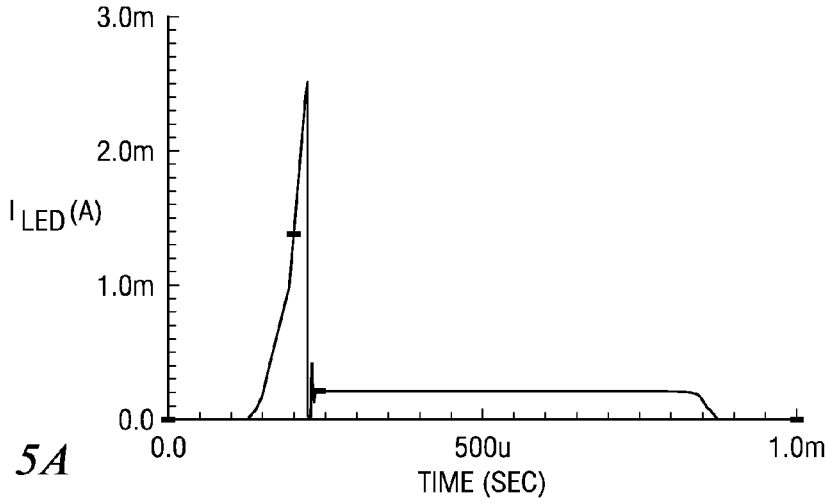
FIG. 5A shows a waveform relating to voltage levels of a conventional driver (FIG. 5A).

FIG. 5A shows a waveform relating to a conventional driver. FIG. 5A shows the LED current $I_{LED}$ as function of time in the conventional driver, while the supply voltage $V_{LED}$ is ramped up with a slew rate of 4 V/ms. Accordingly, there is a large overshoot (the large peak in FIG. 5A) when the voltage $V_{LED}$ increases rapidly and exceeds a minimum threshold level. In this example, the LED current was set to 200 μA.

Figure 5B:
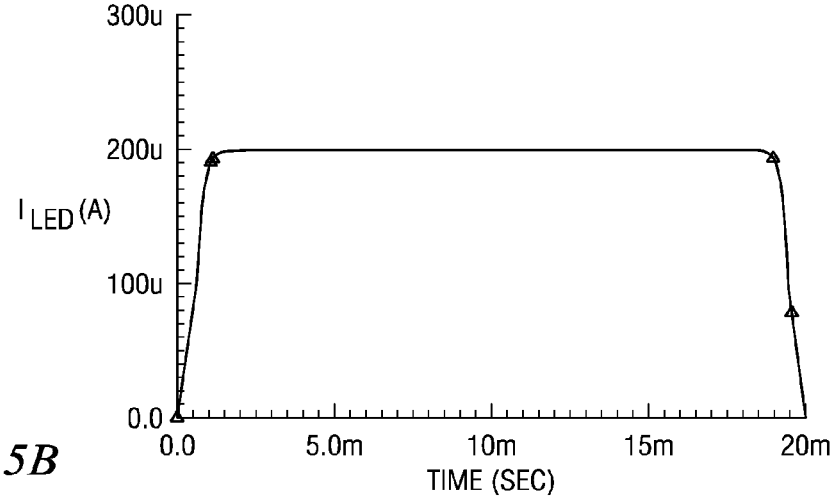
FIGS. 5B-5C show waveforms relating to voltage levels of the driver of FIG. 4.

FIG. 5B shows a transient response of the LED current $I_{LED}$ for the embodiment shown in FIG. 4. The supply voltage $V_{LED}$ increases with 150 mV/ms and the current through the LED was set to 200 μA. The current shows no overshoot.

Figure 5C:
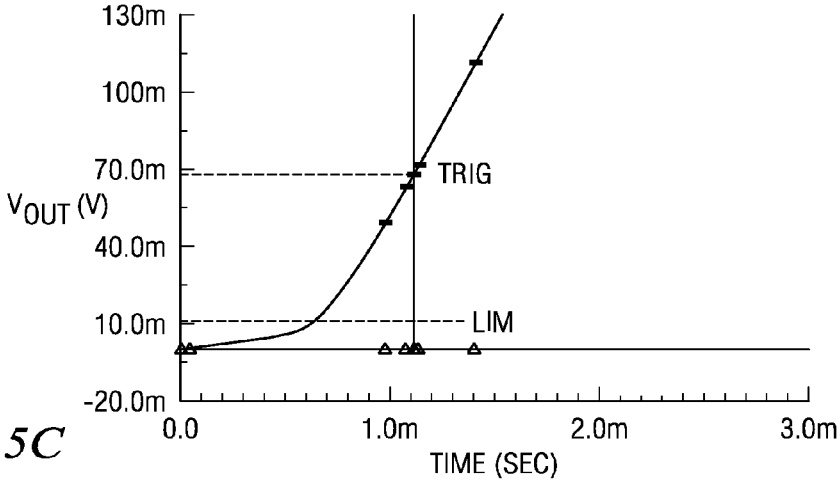

FIG. 5C shows the output voltage $V_{OUT}$ for the driver according to the embodiment of the invention shown in FIG. 4. Iset can be assumed to be 200 μA. Again, the supply voltage $V_{LED}$ ramps up with specific slew rate and $V_{OUT}$ follows after a first slewing period. The minimum drain source voltage at which the output of Schmitt-Trigger $INV_1$ switches from low to high is indicated with TRIG and is at about 70 mV. The detection signal, i.e., the output signal of Schmitt-Trigger $INV_1$ is used to modify the circuit operating points according to the requirements. This can for example be a hysteresis allowing high efficiency without any overshoot due to later turn on. Below 10 mV, indicated with the dashed line LIM, the control loop would stop operation. With a higher current Iset>200 μA the lower limit LIM increases to higher voltage levels. Therefore, the switching point TRIG at 70 mV is a good compromise.

Embodiments having different combinations of one or more of the features or steps described in the context of example embodiments having all or just some of such features or steps are intended to be covered hereby. Those skilled in the art will appreciate that many other embodiments and variations are also possible within the scope of the claimed invention.

What is claimed is:

1. An electronic device comprising a driver for light emitting semiconductor devices, the driver comprising:

a first MOS transistor coupled with a channel to the light emitting semiconductor device at an output node; the first MOS transistor being configured to determine a current through the light emitting semiconductor device;

a control loop configured and adapted to control the first MOS transistor to maintain the magnitude of the current through the light emitting semiconductor device at a target value when a voltage drop across the first MOS transistor changes;

a second MOS transistor coupled to the output node and biased so as to supply an auxiliary current to the output node, when the voltage drop across the first MOS transistor drops below a minimum voltage level; and a feedback loop configured and adapted to reduce the current to be fed through the light emitting semiconductor device by an amount proportional to the auxiliary current.

2. The device of claim 1, further comprising:

a first current mirror coupled with the first MOS transistor so as to define the current to be supplied to the light emitting semiconductor device; the second MOS transistor being coupled to the first current mirror so as to draw a current from the first current mirror which has magnitude proportional to the magnitude of the auxiliary current, in order to reduce the amount of current mirrored to the first MOS transistor.

3. The device of claim 1, wherein the auxiliary current flows as an inverse current through the second transistor.

4. The device of claim 1, further comprising a detection stage for detecting that the voltage drop across the channel of the first MOS transistor drops below a minimum voltage level, and for issuing a corresponding detection signal.

5. The device of claim 4, further comprising control circuitry for selectively adjusting a control voltage of the second MOS transistor in response to the detection signal.

6. The device of claim 4, further comprising control circuitry for selectively adjusting a control voltage of the second MOS transistor in response to the amount of current to be fed to the light emitting semiconductor device.

7. A method for operating a driver for a light emitting semiconductor device, the method comprising:

supplying a current to the light emitting semiconductor device through a first transistor of a current mirror;

controlling the current mirror so as to maintain a target magnitude of the output current through the first transistor, if the voltage drop across the channel of the first transistor varies;

feeding an auxiliary current to a channel of the first transistor, when the voltage drop across the first transistor drops below a minimum voltage level; and reducing the current mirrored to the first transistor by an amount proportional to the auxiliary current.

8. The method of claim 7, further comprising:

issuing a detection signal, when the voltage drop across the channel of the first transistor drops below a minimum voltage level.

9. The method of claim 8, further comprising:

adjusting a control voltage of the second transistor in response to either one or both of the detection signals and the magnitude of the output current setting.

* * * * *